US008171828B2

(12) United States Patent
Duvan et al.

(10) Patent No.: US 8,171,828 B2
(45) Date of Patent: May 8, 2012

(54) ELECTROMECHANICAL WRENCH

(75) Inventors: David Duvan, Chino, CA (US); Tony Duvan, Anaheim, CA (US)

(73) Assignee: Digitool Solutions LLC, Chino, CA (US)

( * ) Notice: Subject to any disclaimer, the term of this patent is extended or adjusted under 35 U.S.C. 154(b) by 322 days.

(21) Appl. No.: 12/653,215

(22) Filed: Dec. 9, 2009

(65) Prior Publication Data

US 2011/0132157 A1 Jun. 9, 2011

(51) Int. Cl.
*B25B 23/144* (2006.01)
*B25B 23/159* (2006.01)

(52) U.S. Cl. ..... 81/479; 73/862.21; 73/862.27

(58) Field of Classification Search ..... 81/467, 81/469, 478–480; 73/862.21–862.23, 862.27
See application file for complete search history.

(56) References Cited

U.S. PATENT DOCUMENTS

| | | | | |
|---|---|---|---|---|
| 4,845,998 | A | 7/1989 | DeMartelaere et al. | |
| 5,172,616 | A * | 12/1992 | Negishi | 81/467 |
| 5,476,014 | A | 12/1995 | Lampe et al. | |
| 5,501,107 | A | 3/1996 | Snyder et al. | |
| 5,581,042 | A | 12/1996 | Tambini | |
| 5,589,644 | A | 12/1996 | Becker et al. | |
| 6,119,562 | A | 9/2000 | Jenkins | |
| 6,167,788 | B1 | 1/2001 | Schonberger et al. | |
| 6,276,243 | B1 | 8/2001 | Jenkins | |
| 6,526,853 | B2 | 3/2003 | Jenkins | |
| 6,629,055 | B2 | 9/2003 | McGee et al. | |
| 6,965,835 | B2 | 11/2005 | McGee et al. | |
| 6,968,759 | B2 | 11/2005 | Becker et al. | |
| 7,047,849 | B2 | 5/2006 | Lai | |
| 7,082,866 | B2 | 8/2006 | Becker | |
| 7,313,990 | B1 | 1/2008 | Shiao | |
| 7,370,539 | B2 | 5/2008 | Gharib et al. | |
| 7,469,602 | B2 | 12/2008 | Gharib et al. | |
| 7,469,619 | B2 | 12/2008 | Anjanappa et al. | |
| 7,565,844 | B2 | 7/2009 | Crass et al. | |
| 2007/0227316 | A1 * | 10/2007 | Lucke et al. | 81/478 |
| 2008/0208522 | A1 * | 8/2008 | Lucke | 702/151 |
| 2009/0078057 | A1 * | 3/2009 | Schultz et al. | 73/862.23 |

* cited by examiner

*Primary Examiner* — David B Thomas
(74) *Attorney, Agent, or Firm* — Raymond Sun

(57) ABSTRACT

An electromechanical wrench has a housing that has a working end and a gripping end, with a driver positioned at the working end, and a handle positioned at the gripping end. The wrench further includes a click wrench emulator mechanism provided at the handle. A method of using an electromechanical wrench to secure a fastener using angular measurement without the need for establishing a zero reference point, and allowing for ratcheting, is also provided. A method of counting the number of fasteners secured by an electromechanical wrench during a wrenching job is further provided.

13 Claims, 10 Drawing Sheets

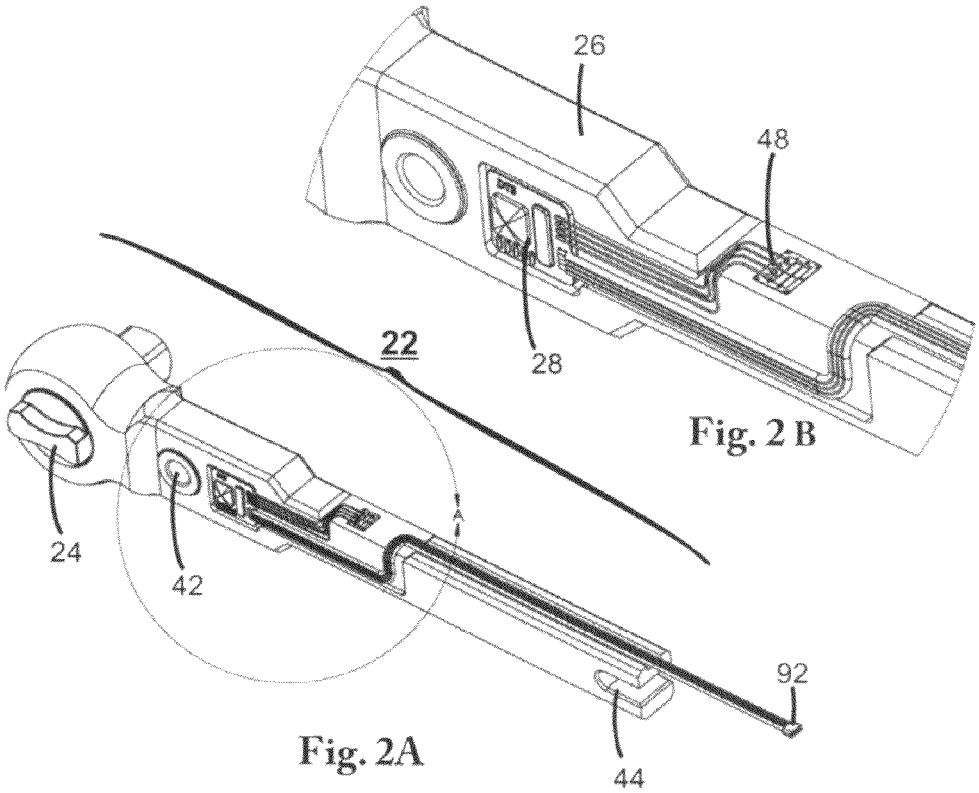
Fig. 2 B
Fig. 2A
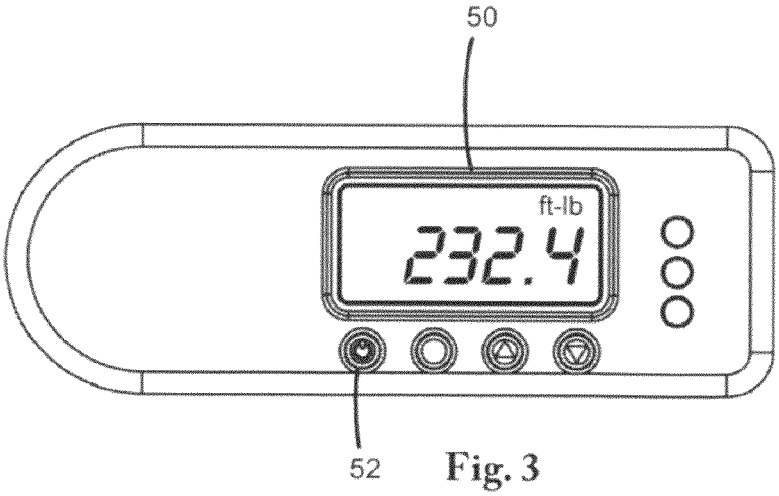
Fig. 3

ELECTROMECHANICAL WRENCH

BACKGROUND OF THE INVENTION

1. Field of the Invention

The present invention relates to torque wrenches, and in particular, to a hand-operated electronic wrench employing an electromechanical release that is triggered by adjustable torque and/or angle measurement parameters.

2. Description of the Prior Art

Hand operated torque wrenches are commonly available in many configurations, including simple bending beam, dial, preset and adjustable click, and electronic signaling types. The simple bending beam wrench is grip-sensitive thereby requiring the user to maintain a certain hand-hold position. The user must watch a pointer and its associated calibrated scale while applying load to a threaded fastener. Its accuracy is compromised by the parallax between the pointer and the calibrated scale. The dial type wrench is not grip sensitive, but the user must monitor its mechanical dial pointer against a calibrated scale during use. Although fundamentally more accurate, interpretation of the dial display is subject to parallax error. Certain dial wrenches have been fitted with an adjustable preset pointer that contacts the measurement pointer completing an electrical circuit that drives a signaling device, such as a lamp or a buzzer. These electric dial wrenches allow wrench operation without watching the dial.

Mechanical click type wrenches are most common. They provide an audible and tactile signal to the user when a preset torque is reached. The adjustable click types feature a calibrated scale on the body of the wrench and are preset by turning a micrometer type handle grip to the desired torque value. The torque preset scale is often misread on adjustable wrenches due to interpretation between the scale and the handle position. The release mechanism of adjustable click wrenches exhibits a slight reduction in torque at the moment of signal alert that encourages the user to cease applying load. However, this characteristic is diminished at lower torque settings and may be missed altogether by the user. Click wrenches are also hand-hold position sensitive. Most mechanical wrench types have been offered with multiple measurement scales, such as Nm and ft-lb or in-lb and cm Kg.

Because of their improved accuracy, electronic torque wrenches have been traditionally used in more critical applications. Electronic wrenches improve functionality by providing additional measurement features such as, torque tracking, peak reading capture, torque units conversion, data storage, and multiple and early warning presets. The concept of torque-angle (also known as torque-turn) fastener installation was made possible with the introduction of wrenches that could sense both torque and angular rotation. The advent of microelectronics has allowed significant cost reductions in electronic wrench manufacture thereby allowing the advantages of electronic wrench features to be experienced by all torque wrench users. In addition to a digital display of measurement parameters, torque and angle preset signaling has typically been accomplished using lights, sounds and vibrating motors.

Presently available electronic torque wrenches lack the sound and tactile feel of the mechanical click wrench. Although an attempt was made to provide a workable solution in U.S. Pat. No. 6,119,562, a number of disadvantages remain. For example, the sensing element is a part of the release mechanism, which compromises the accuracy and usability of the measurement during and after the release. In addition, the sensor element, being a part of the release mechanism, negates the feasibility of interchangeable drivers. The triggering methods suggested for the release mechanism must be driven into a reset position by the actuator after release.

In addition, angle measuring instruments currently on the market that use gyro or accelerometer technology require the establishment of a "zero point" reference. This is because this type of technology cannot differentiate between rotation on or off the fastener. This causes the sensor to capture an offset that causes the display to drift at a rate that is relative to any motion experienced during the zeroing mode. Therefore, the measurement instrumentation is either held in a state of reset, or is manually reset to zero just prior to actual measurement. Examples include an SPX torque-angle adaptor, as disclosed in U.S. Pat. No. 6,965,835, and an "angle zero set" reference, as disclosed in U.S. Pat. No. 7,565,844, which set a "zero point reference" prior to angle measurement. This generally involves holding the sensing element still for a defined period of time during the power-up function or after pushing a button to initiate the zeroing function. If the operator moves (even slightly) during the zeroing function, the motion will be captured and interpreted as "zero" and added to an actual reading as an offset. More dramatically, if such offset is captured during the zeroing function, and the wrench or adaptor is subsequently held still, the display will begin incrementing or decrementing as though the wrench or adapter were moving.

Because there is no physical zero angle reference for the gyro or accelerometer sensors, existing products cannot include compensation for zero drift. Zero drift of the sensor also causes the display to increment or decrement due to environmental influences, such as temperature and pressure changes, over time. To insure continued accuracy of the angle measurement during use, the products must be manually zeroed by reinitiating the power-on function or by pushing the zeroing button.

Another problem that is frequently experienced by conventional electromechanical torque wrenches relates to the ratcheting motion. The application of torque and angular rotation to a fastener is rarely accomplished in one continuous stroke of a wrench. A ratcheting drive between the wrench and the work allows fastener installation in repeatedly segmented strokes. This facilitates ergonomic as well as workspace clearance limitations. In the measurement of torque and angle parameters during a ratcheting sequence, certain manipulation of the sensed signals must be accomplished. Torque is cumulative in the work. The repeated application of segmented rotation results in higher torque readings for each subsequent stroke. Therefore, the amount of torque applied can be monitored without regard to previous readings. However, for angle measurement, the ratcheting motion is opposite the direction of rotation for fastener installation. Therefore, the accumulation of the angle reading must be noted for the prior stroke, the reverse rotation ignored, and further advancement (at the subsequent applications of rotation) added on.

The present invention significantly improves the functionality of the torque and angle measurements and overcomes the major disadvantages of the prior art.

SUMMARY OF THE DISCLOSURE

It is an object of the present invention to an electromechanical torque wrench that overcomes the drawbacks of, and improves upon, the prior art.

In order to accomplish the objects of the present invention, there is provided an electromechanical wrench that has a housing that has a working end and a gripping end, with a driver positioned at the working end, and a handle positioned at the gripping end. The wrench further includes a click wrench emulator mechanism provided at the handle, the mechanism including a handle lever that partially extends outside the housing at the handle and which is pivotally coupled to the housing, a hammer that resides inside the housing and is pivotally coupled to the housing, the hammer having a striking edge that is normally spaced-apart from the handle lever, a sear pivotally coupled to the housing and having a portion thereof that normally engages the hammer, and a solenoid coupled to the sear by a solenoid core rod. The solenoid is actuated to cause the sear to pivot, thereby causing the sear to be disengaged from the hammer, so that the hammer is released to cause the striking edge to strike the handle lever.

The present invention also provides a method of using an electromechanical wrench to secure a fastener using angular measurement with continuous zero reference point and sensor drift updating, and allowing for ratcheting where (i) angular measurement is initiated at the detection of a very low torque value as it is first applied to the fastener, and (ii) the accumulation of angular measurement relies upon the detection of a torque value that is higher than the previous torque value.

The present invention also provides a method of counting the number of fasteners secured by an electromechanical wrench during a wrenching job.

BRIEF DESCRIPTION OF THE DRAWINGS

FIG. 2A is a perspective view of the drive head and sensor beam assembly of the wrench of FIG. 1.

FIG. 2B is an enlarged perspective view of the area labeled A in FIG. 2A.

FIG. 3 illustrates the display, keypad and controller module of the wrench of FIG. 1.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
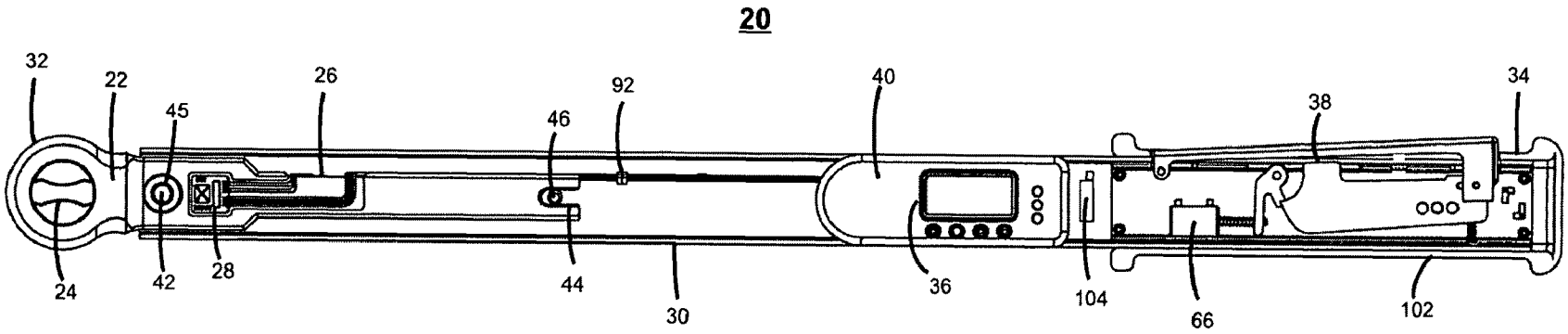
FIG. 1 is a cross-sectional view of a wrench according to the present invention.

FIG. 1 illustrates a wrench 20 according to the present invention. The wrench 20 includes four main sections:

1. The drive head and sensor beam assembly 22 that includes a ratchet head driver 24, a torque sensing beam 26 and a signal processing module 28 that has a non-volatile calibration memory.
2. The wrench housing 30 that includes a working end 32 and a gripping end 34. The housing 30 can be a (metal) tubular element suitably sized to accommodate the drive head and sensor beam assembly 22, a display controller 36 and a "click" wrench emulator mechanism 38. The length and material strength of the housing 30 is dictated by torque wrench industry standards relating applied torque to hand loading.
3. The display and controller module 40 for user interface that may include visual, audible and tactile warning signals, and serial communications to external systems.
4. A "click" wrench emulator mechanism 38 that provides emulation of both audible and tactile signals typical of mechanical preset or adjustable torque wrenches.

The electrical interconnections between the drive head and sensor beam assembly 22, the display controller 36, the display controller 36 and the "click" wrench emulator mechanism 38 can be accomplished using standard wiring and connector practices.

Figure 6:
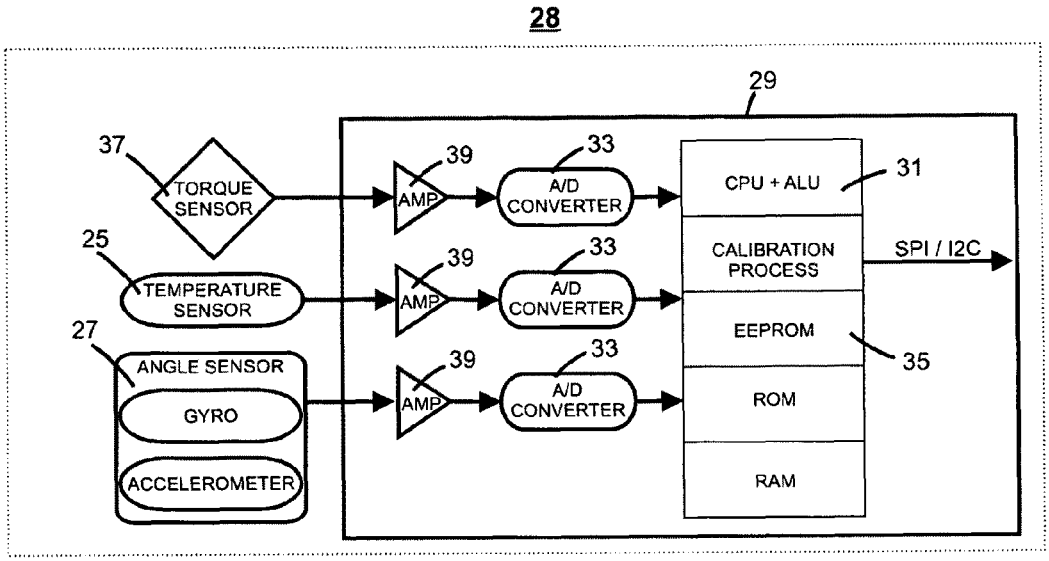
FIG. 6 is a block diagram of the drive head and sensor beam assembly of the wrench of FIG. 1.

Referring now to FIGS. 2A and 2B, the drive head and sensor beam assembly 22 includes a ratchet head driver 24. Even though the driver 24 is described herein in connection with a ratchet head driver, the term "driver" as used herein can include a fixed square drive, ratcheting drive, open end or box end drives. The drive head and sensor beam assembly 22 is removable, so it features a mounting hole 45 that is aligned with an attachment pin 42 that passes through the mounting hole and which is retained by the wrench housing 30. With reference to this pin 42 at one end, the torque-sensing beam 26 is terminated at its opposite end with a slot 44 that mates with a second pin 46 in the housing 30. As torque is applied to the ratchet head driver 24, the beam 26 bends proportionately between these two pins 42, 46. A strain gauge bridge 48 centered on the beam 26 (using well-known application techniques) senses the bending of the beam 26. Even though FIGS. 1, 2A and 2B show one strain gauge 48, it is possible to provide more than one strain gauge. As the distances between the ratchet head driver 24 (i.e., at its center), the sensor beam pivot pin 42 and the slotted end 44 of the sensor beam are fixed, hand-hold position error is minimized. Referring also to FIG. 6, a three-axis accelerometer or suitable gyro sensor 27 is part of the signal processing module 28 and is also appropriately positioned on the sensor beam assembly 22 to sense wrench rotation. A microcontroller circuit 29 (which includes a central processing unit (CPU) 31 and analog to digital (A/D) converter elements 33) is also part of the signal processing module 28 and is integral with the sensor beam assembly 22 and receives the strain gauge and accelerometer (analog) signals; and translates them into a digital data stream for use by the display and controller module 40. Calibration scaling of the torque and angle signals is stored on an EEPROM 35 in the circuit 29, making the assembly interchangeable between different wrench housings 30 without the need for recalibration.

Referring to FIG. 3, the display and controller module 36 includes a dot matrix or segmented LCD display 50 and a sealed keypad or touch screen 52 for program and preset adjustment. The display 50 may serve to indicate torque and/or angle measurement values, torque and/or angle preset values, torque units of conversion, user instruction, warnings and alerts, among other parameters and measurements. Depending on the complexity of the particular measurement and control functions, the display 50 and the keypad 52 can be used for additional functions such as torque or angle tracking, peak capture, fastener count, or assembly sequence callouts and validations by the user. These diverse functions may be requested by a particular customer given specific product definitions or wrenching needs. The implementation would be done in software with the display and input/output (keypad and signal alerts) assigned according to the customer's specifications. Such custom configurations could be downloaded into the wrench from a computer via communication interface 100, for example. The wrench 20 itself may be used to calibrate the drive head and sensor beam assembly 22 by manipulation of the keypad 52 in response to the display of known torque levels and angular rotation. For example, if a known quantity of torque and/or angular rotation is applied to the wrench 20, the display 50, keypad 52 and an associated "calibration procedure" could be used to instruct the wrench 20 to recognize such stimulus and to store it as a scaling of the resulting sensed input signals.

Figure 4A:
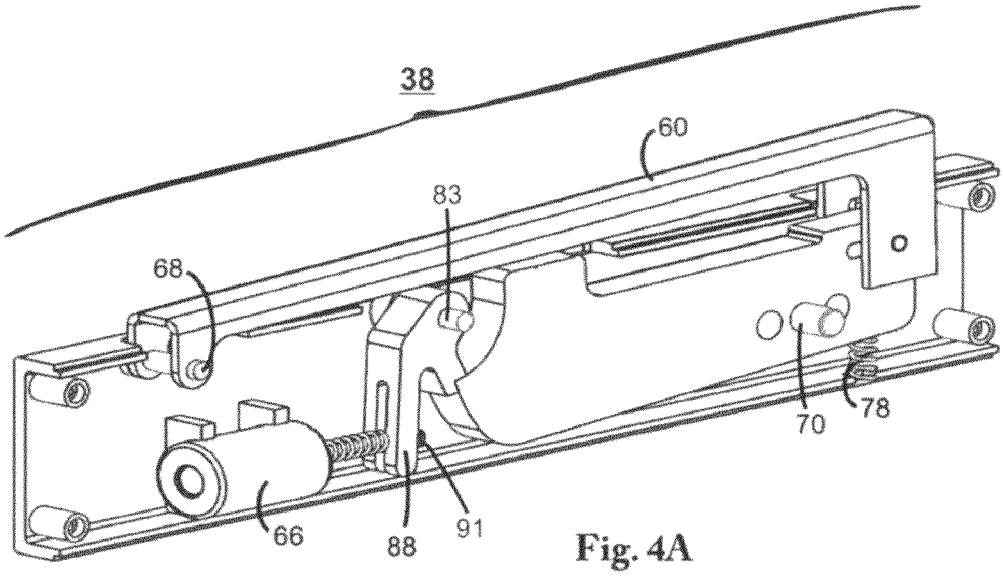
FIG. 4A is a perspective view of the click mechanism of the wrench of FIG. 1 shown in the set position.
Figure 4B:
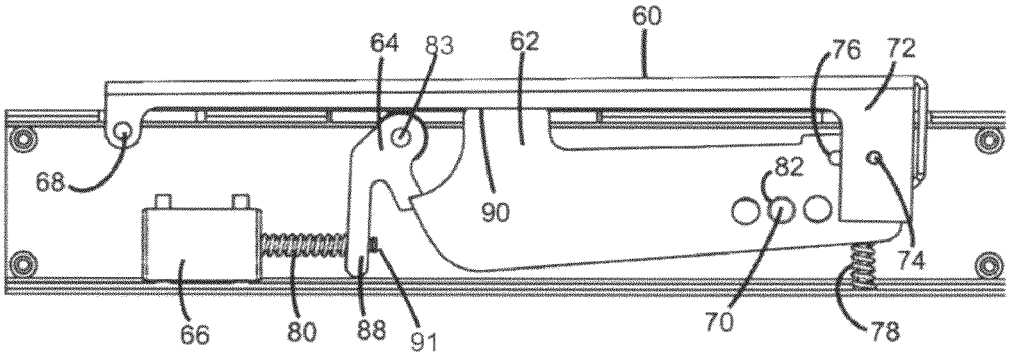
FIG. 4B is a cross-sectional view of the click mechanism of the wrench of FIG. 1 shown in the set position.
Figure 5:
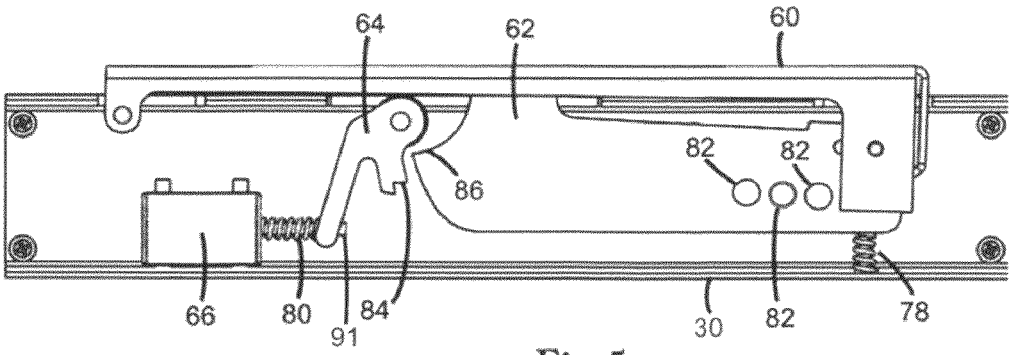
FIG. 5 is a cross-sectional view of the click mechanism of the wrench of FIG. 1 shown in the released position.

Referring to FIGS. 4A, 4B and 5, the click wrench emulator mechanism 38 includes a handle lever 60, a hammer 62, a sear 64, a solenoid 66, and a number of pivot pins and springs. The handle lever 60 extends outside the housing 30, and pivots about a pin 68 adjacent one end, which is loaded in a clockwise direction (as viewed through the orientation of FIG. 4B) by the user's hand pressing on the handle lever 60. The pin 68 couples the handle lever 60 to the wrench housing 30. Similarly, the hammer 62 pivots about another pin 70 adjacent an opposite end and is loaded in a clockwise direction (as viewed through the orientation of FIG. 4B) by the handle lever 60. The pin 70 couples the hammer 62 to the handle end of the wrench housing 30. A pair of engagement arms 72 on the handle lever 60 extends downwardly to straddle the hammer 62. A pin 74 extends through the arms 72 and a slot 76 in the hammer 62 to pivotally couple the handle lever 60 and the hammer 62. The slot 76 is sized and configured to allow for independent rotational motions of the handle lever 60 and the hammer 62. A hammer spring 78 is coupled to the housing 30 and the hammer 62, and biases the hammer 62 in a counterclockwise direction (as viewed through the orientation of FIG. 4B) so as to provide reset action when the handle lever 60 is released. The sear 64 is pivotally connected to the housing 30 via a pin 83 and has a notched edge 84 (see FIG. 5) that is normally seated on a stepped edge 86 at one end of the hammer 62. A solenoid 66 is fixed to the inside of the housing 30. A sear spring 80 is attached over the core rod 91 of the solenoid 66 to maintain bias between the solenoid 66 and the sear tail 88 of the sear 64 to pivot the sear 64 in a counter-clockwise direction (as viewed through the orientation of FIG. 4B) to provide a sear reset action. The pivot pin 70 is received in one of a plurality of pivot holes 82 provided along the hammer 62, thereby allowing proportional action and felt response for wrenches of various size and torque capacity. A plastic handle 102 can be installed over the handle end of the housing 30 to provide ergonomic comfort. The wrench housing 30 and the handle 102 are open near the top to allow the hammer 62 to strike the handle lever 60 directly, thereby providing a more distinctive tactile feel at preset coincidence.

FIG. 5 illustrates the position of the click wrench emulator mechanism 38 subsequent to the release position. The release position occurs when the target torque has been reached. At that instant, the core rod 91 of the solenoid 66, moving laterally in the leftward direction shown in FIG. 5, pulls the tail 88 of the sear 64 (also compressing the sear spring 80) to pivot it in a clockwise direction, causing the notched edge 84 to disengage from the stepped edge 86 on the hammer 62. As a result, the sear 64 disengages from the hammer 62, allowing the hammer 62 (as loaded through the handle lever 60) to rotate in a clockwise direction so that its striking edge 90 (see FIG. 4B) strikes the handle lever 60 to create an audible click. As a result, a tactile impulse is felt in the operator's hand and slight reduction of torque load is also sensed by the operator as the handle lever 60 rotates into the housing 30. Thus, the audible and tactile functions simulate the response of a conventional adjustable or preset torque wrench.

In addition to the audible click, tactile impulse and reduction in torque load, the user will feel a vibration that is caused by a vibrator 104 (which includes a vibrating motor) (see FIG. 1). When the target torque is approached (e.g., at about 90 percent of the target torque), the CPU 94 in the module 40 (see also FIG. 7) will actuate the vibrator 104. Thus, the tactile vibration alerts the operator of the impending preset coincidence. As the solenoid 66 action is limited in duration, the entire assembly returns to the reset position (shown in FIG. 4) when the handle lever 60 is released.

FIG. 6 is a block diagram of the signal processing module 28 that is integral with the drive head and sensor beam assembly 22. Integral construction ensures accurate four-wire interface to the strain gauge bridge 48 without compromise due to contact integrity. In the present invention, a three-axis accelerometer 27 can be employed for sensing the angular rotation of the ratchet head driver 24. Since the three-axis accelerometer 27 is positioned in close proximity to the center of rotation, the effects of housing deflection due to loading are minimized. A piezoelectric gyro sensor (also denoted by 27) may be used in place of the three-axis accelerometer 27 for angle sensing. As the calibration parameters are stored in the EEPROM 35 (Electrically Erasable Programmable Read Only Memory), quick tool change is possible without the need for recalibration. The signal processing module 28 communicates with the display and controller module 40 via interconnects and cables 92 using Industry Standard I SPI or I2C serial interface.

As explained elsewhere herein, the signal processing module 28 also includes a torque sensor 37 that is coupled to an ND converter 33 via an amplifier 39. The angle sensor 27 (either a gyro sensor or a three-axis accelerometer) is coupled to another ND converter 33 via another amplifier 39. The ND converters 33 are in turn coupled to the processor which includes the CPU 31, the EEPROM 35, and additional memories (e.g., a RAM and a ROM as shown in FIG. 6).

Figure 7:
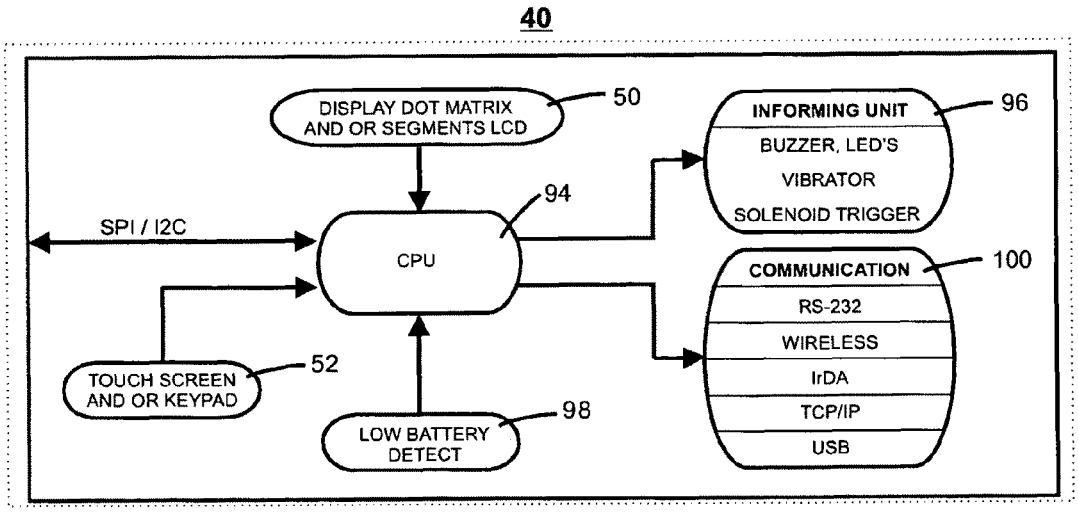
FIG. 7 is a block diagram of the display, keypad and controller module of the wrench of FIG. 1.

FIG. 7 is a block diagram of the display and controller module 40 and shows the basic input/output functions that include the SPI or I2C interface for the sensor module 28, a CPU 94 coupled to the interface, and the dot matrix or segmented LCD display 50 and the keypad or touch screen 52 that are both coupled to the CPU 94 for user setup, battery management, output alerts and controls and interface communication options.

The display 50 provides calibration instruction, preset adjustment and input monitoring of the torque and angle parameters. The display digits present real-time indication to the user during wrenching operations. The background and digit color changes may be used to alert the user to preset, fault or over range conditions. The keypad or touch screen 52 accepts the selection of operational functions including torque or angle input tracking, peak detection, preset values, units-of-measure selection, audible, visual and tactile alerts, data storage and retrieval, calibration procedures and custom programs. An informing unit 96 (which is coupled to the CPU 94) drives visual indicators, such as light emitting diodes (LEDs), audible buzzers or sounders, vibrator 104, and the solenoid trigger of the electromechanical release mechanism 38 for tactile and "click" preset coincidence alerts. In addition, system power is provided by a battery 98, such as a single Li-Ion cell. The CPU 94 manages the charge and discharge protection levels for the cell. The CPU 94 uses its internal voltage reference in a ratio-metric fashion to regulate power to the torque and angle sensors through the SPI or I2C interface. In addition, a communication unit 100 allows linking of the display and controller module 40 to computers, printers, data loggers, or process controller peripherals using links that include Industry Standard serial modes including: RS232, IRDA (Infrared), TCP/IP (Internet Protocol) and USB (Universal Serial Bus). Wireless capability can be included for applications requiring freedom of motion of the user.

According to another aspect of the present invention, it may be desirable to program the wrench 20 to count torque installations, for example, during the installation of lug nuts on a motor vehicle. Specifically, each lug nut for each of the four wheels on a passenger car must be tightened to a common torque value. It is important to count the number of completed lug nut installations for each wheel and in total for the vehicle. The CPU 94 may validate the count before the operator is directed to move on to the next lug nut or to the next wheel. During this process, it is possible that the operator might lose track of which lug nuts have been previously tightened. With the torque and angle measurement parameters available during the tightening routine, a calculation may be made to determine if a particular lug nut has been previously installed. In such a case, the operator will be alerted and the lug nut count would be maintained correctly.

Figure 8:
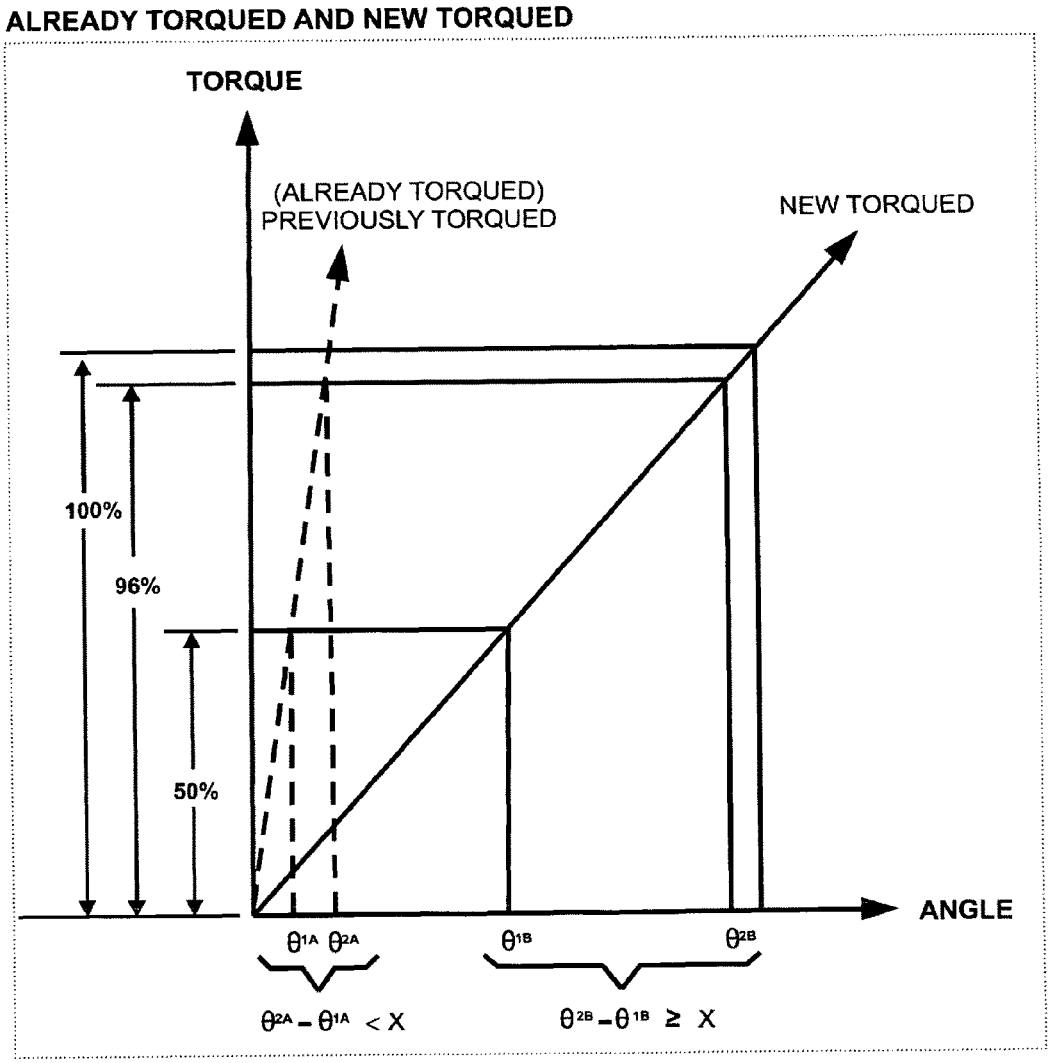
FIG. 8 is a graphic representation of the lug nut counter fault detector function.

FIG. 8 illustrates the torque versus angle measurements for normal (solid line) and "previously installed" (dashed line) projections. Torque values of 50% and 96% of the target torque are compared to simultaneous angular rotation measurements to establish a general slope for a set of lug nut installations. Thereafter, any lug nut that has been previously installed will exhibit a steeper slope that may be mathematically determined by subtracting the first and second angles from the 50% and 96% torque levels and comparing them to the normal values.

Figure 9:
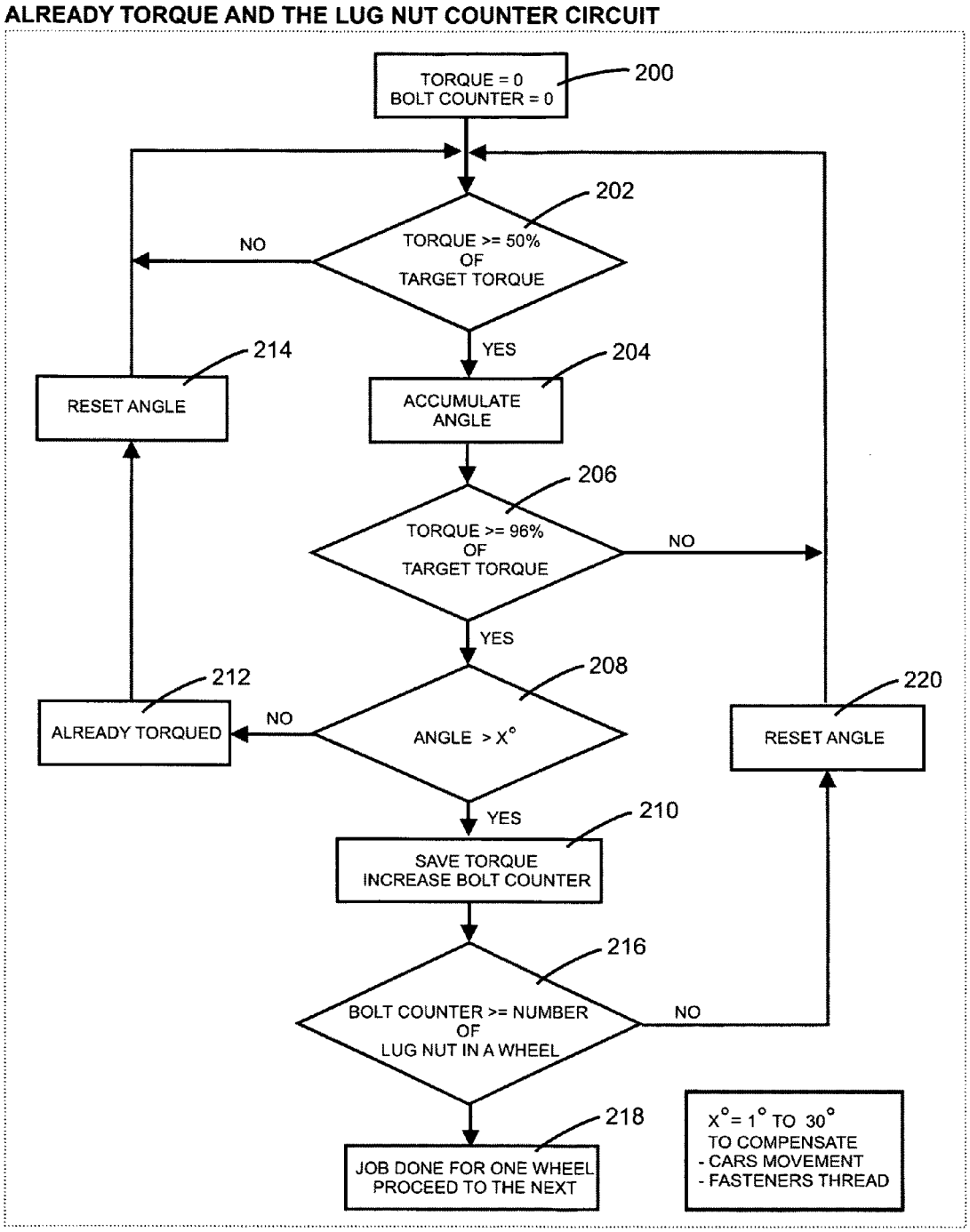
FIG. 9 is a flow chart illustrating the "already torque" and the lug nut counter circuit function.

FIG. 9 is a flow chart illustrating the logical progression of measurement and decision functions for an error checking routine that detects previously installed fasteners as in the example of the lug nut counter suggested above. With initial values for 50% and 96% torque levels established, each lug nut is monitored to compare the torque and angle measurements as described in FIG. 8. In a first step 200, the values (e.g., torque and bolt counter) are initialized, and an angle accumulator accepts angle measurements between the 50% and 96% torque levels. These initial values, torque and angle measurements, and angle accumulation can be maintained within electronic memory registers (e.g., RAM) in module 40. In step 202, it is determined if the torque input drops below the 50% level. If the torque input drops below the 50% level, the angle accumulator will hold its present value and step 202 will be repeated (i.e., the routine will wait) until the 50% level has again been exceeded. If the torque input is greater than or equal to 50% of the target torque, the accumulator adds the angular rotation (step 204), thereby allowing for ratcheting (i.e., repetitive clockwise and counter-clockwise) motion of the wrench 20. In practice, the torque and angle values begin at zero. When torque input exceeds 50% of target level, angular rotation is accumulated, thus allowing for ratcheting motion, as described above. On reaching 96% of the target torque level (step 206), the process checks the accumulated angle for a pre-programmed allowance between 1° and 30° to compensate for vehicle movement (step 208). If the total angle exceeds the allowance, then the fastener is considered properly installed and the bolt counter is incremented (step 210). If the total angle is less than the accumulated amount plus the movement allowance, then the wrench 20 will alert the operator that the fastener is "previously installed" (step 212) and the angle accumulator is reset automatically (step 214). If the total number of bolts counted equals the preset amount for that job (step 216), and the torque-angle comparison is in the normal range, the operator will be informed that the job is complete (step 218). However, if the total number of bolts counted is less than the preset amount for that job, then the angle accumulator is reset (step 220) and the operator will start over with a new lug nut until all the lug nuts have been torqued.

Figure 11:
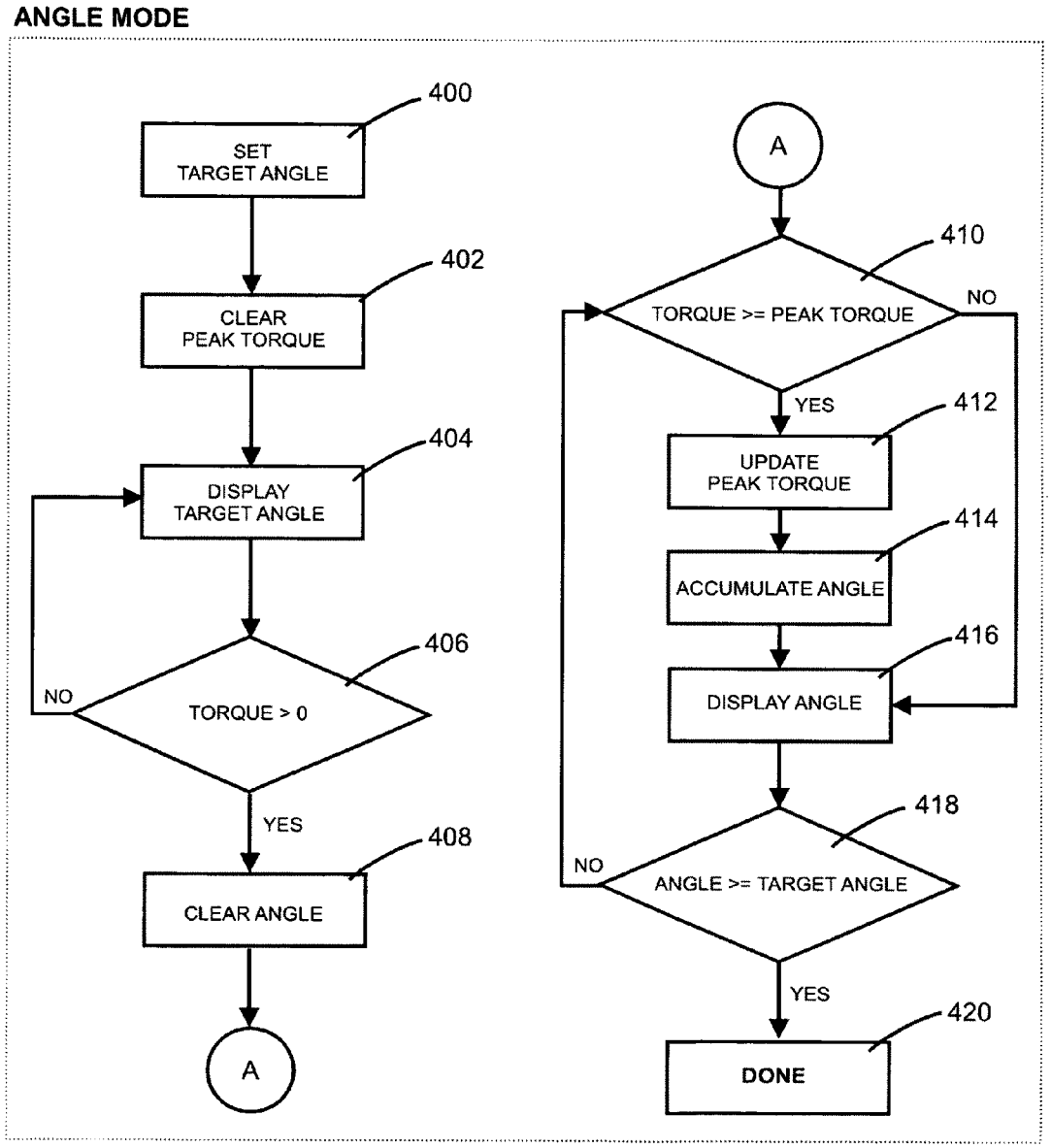
FIG. 11 is a flow chart of the basic angle measurement mode.
Figure 12:
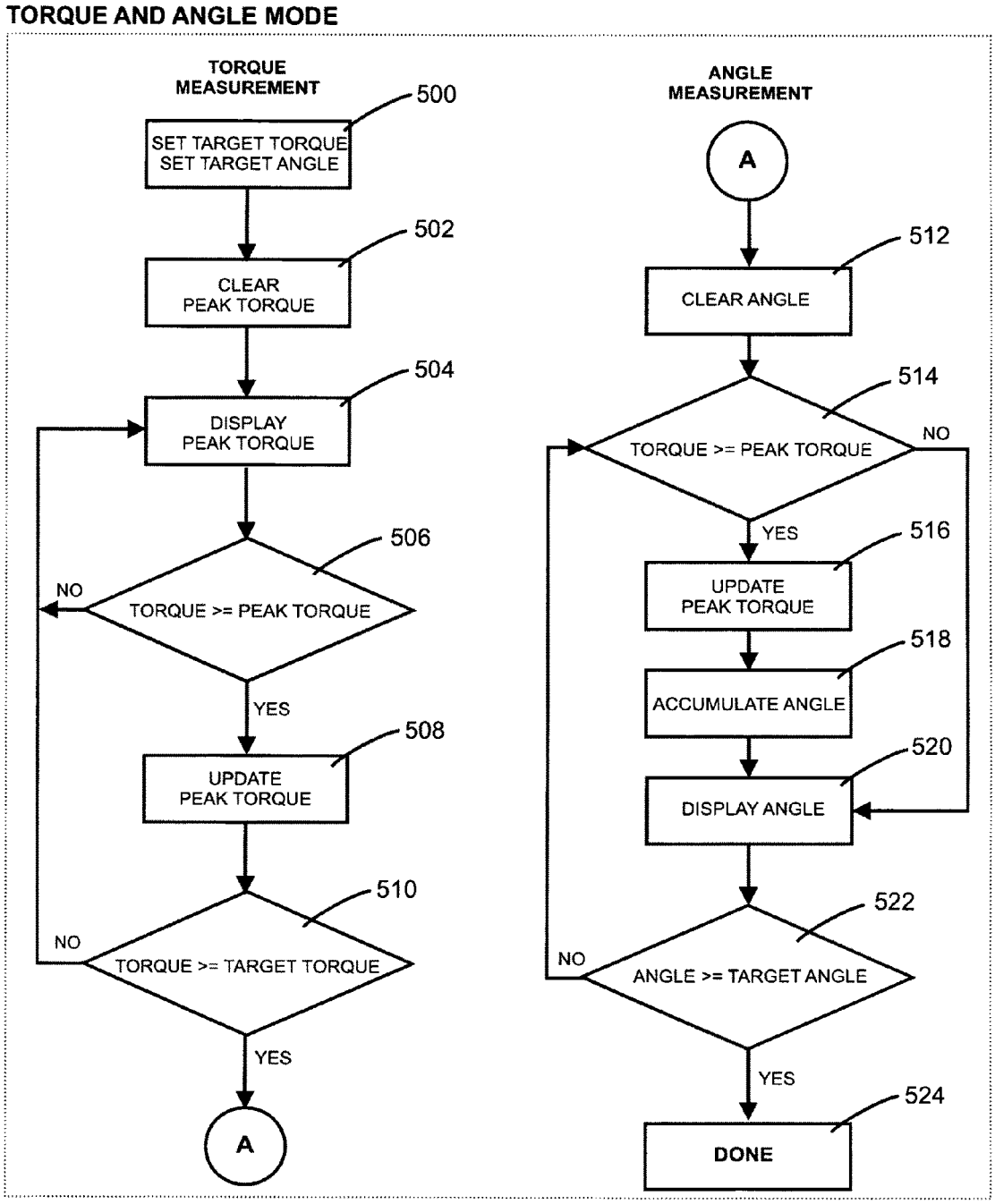
FIG. 12 is a flow chart of the basic torque and angle measurement mode.

The wrench 20 according to the present invention can be operated in three modes, a torque-only mode (see FIG. 10), an angle-only mode (see FIG. 11) and a torque and angle mode (see FIG. 12). Many basic applications require torque-only mode of use, such as after-market automobile wheels. Then, there are some applications where the user already has a preset torque and only needs to measure the angle of rotation. There are also some applications where it is desirable to measure and display the angle of rotation and the torque, such as for bolts used on engine heads.

Figure 10:
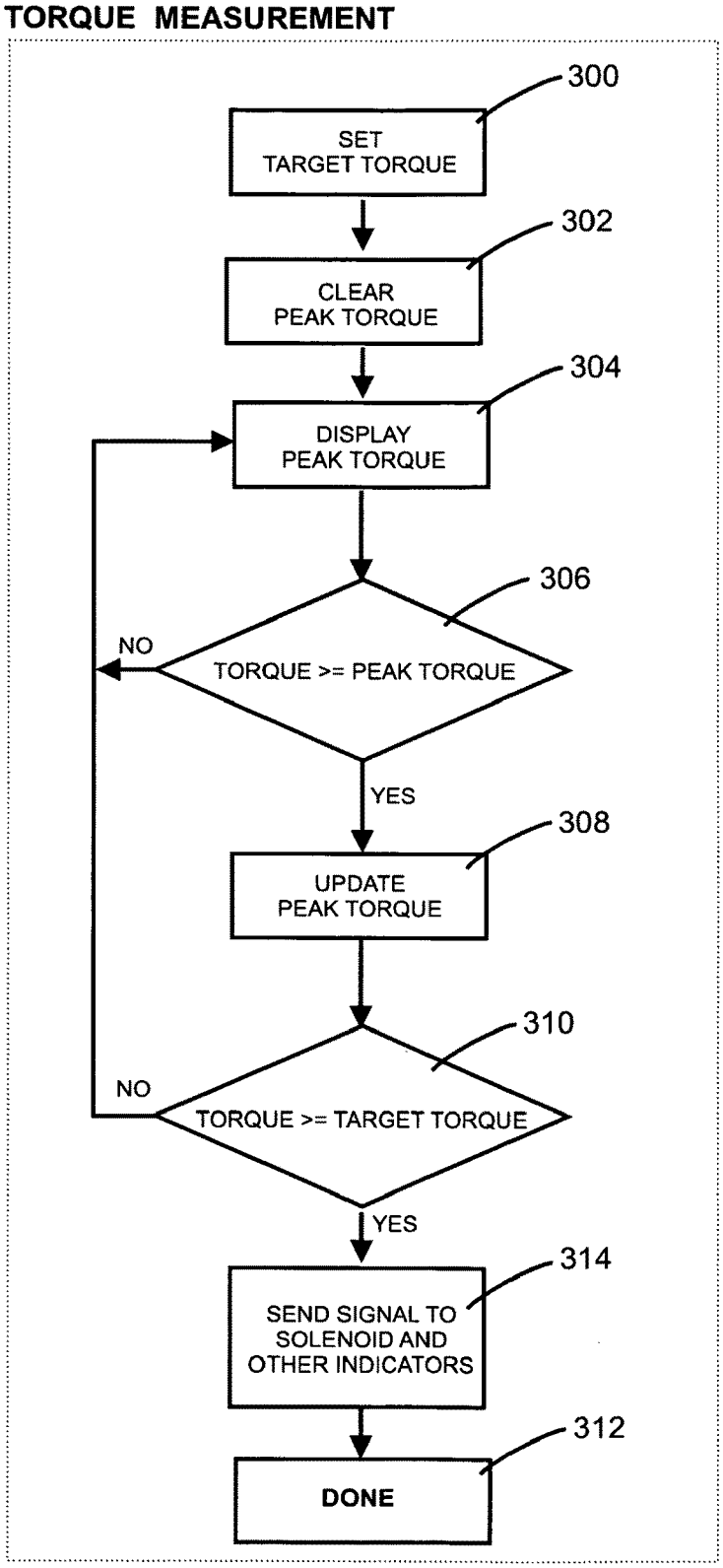
FIG. 10 is a flow chart of the basic torque measurement mode.

The methods set forth in FIGS. 10-12 do not require manually establishing a zero-point reference, and therefore do not require that the wrench 20 be held still during the zeroing process. A method of utilizing simultaneous measured changes of both torque and angle signals allows the automatic establishment of angle zero reference. This method also provides continuous correction of angle signal drift. As described in greater detail below, angular measurement is initiated at the detection of a very low torque value as it is first applied to the fastener. This is made possible by the simultaneous multitasking (measurement of both torque and angle parameters) by the software in (essentially) real time. When the target angle is reached, the wrench 20 automatically resets the angle to zero and is ready for the next fastener installation.

The methods set forth in FIGS. 10-12 also accommodate ratcheting motion. As described above, the initial accumulation of angular rotation relies upon the detection of a very low value of torque. Ratcheting motion is accounted for by noting the peak torque measured at each installation stroke. The advancement of angular measurement thus relies upon the detection of a torque value that is higher than the previous value. Should angular motion be detected at a low torque value (as when the user has moved on to another fastener), then the wrench 20 will determine a new zero point and accumulate angle measurement from that point. An alarm signal or indication may be generated to alert the user that ratcheting mode is reset and that the wrench 20 is on a new installation. Again, when the target angle is reached, the wrench 20 will reset the angle to zero and be ready to manipulate and monitor the next fastener without the need for manual zero point determination. Should the user fail to reach the target angle, the wrench 20 will reset to zero after a predetermined length of time, and an alarm signal or indication may be generated to alert the user that ratcheting mode is reset and that the wrench 20 is ready for a new installation.

FIG. 10 illustrates the flow process for operation in a torque-only mode. In step 300, the user sets the target torque. In step 302, the controller clears the peak torque register and the display 50 shows the peak torque value (which initially would be "zero") in step 304. As torque is applied, the peak torque value is continually updated and displayed (see steps 304, 306 and 308) until the target torque is reached (preset coincidence). When the target torque value is reached (step 310), the solenoid 66 is actuated by the CPU 94 to cause the click wrench emulator mechanism 38 to assume the release position shown in FIG. 5 to generate the audible click, tactile impulse and slight torque load reduction (step 314), and the process comes to an end (step 312).

FIG. 11 illustrates the flow process for operation in the angle-only mode. In step 400, the user sets a target angle (preset) value. The CPU 94 clears the peak torque register (step 402), and the display 50 shows the angle preset value (step 404). Any torque applied to the wrench 20 will clear the angle display (steps 406 and 408), indicating "zero". Increasing torque measurements will update the peak torque value (steps 410 and 412), and allow accumulation of angle measurement (step 414), which is displayed (step 416). If the torque reading is not increasing in step 410, processing proceeds to step 416 and the angle display will hold the last reading (even if angular rotation is measured). This allows reverse (ratcheting) motion of the wrench 20 without affecting the angle reading. The accumulation of angle measurement resumes when torque is again increasing beyond the last recorded peak torque value. When the angle measurement equals its target value (preset coincidence) in step 418, the solenoid 66 is actuated by the CPU 94 to cause the click wrench emulator mechanism 38 to assume the release position shown in FIG. 5 to generate the audible click, tactile impulse and slight torque load reduction (step 420). If angular motion is then sensed with the application of low torque (as when the user has moved on to another fastener) the CPU 94 clears the angle accumulation and reinitializes the process (step 402). The LEDs, audible buzzer or tactile vibration motor may also be driven by the informing unit 96 to alert the operator to various error or alert signals.

FIG. 12 illustrates the flow process for operation in the torque and angle mode. In step 500, the user sets target torque and target angle (preset) values. The CPU 94 clears the peak torque register (step 502) and the display 50 shows the peak torque value (which initially would be "zero") in step 504. As torque is applied (step 506), the peak torque value is continually updated (step 508) and displayed (step 504). When the target torque value is attained (step 510), the CPU 94 switches to the angle measurement mode clearing the display to "zero" (step 512). Increasing torque measurements (step 514) will update the peak torque value (step 516) and allow accumulation (step 518) and display (step 520) of angle measurement. If the torque measurement is not increasing (from step 514), processing will proceed directly to step 520 where the angle display will hold the last reading. This allows reverse (ratcheting) motion of the wrench 20 without affecting the angle reading. The accumulation of angle measurement (step 518) resumes when torque is again increasing beyond the last recorded peak torque value (step 516). When the angle measurement equals its target value (step 522), the solenoid 66 is actuated by the CPU 94 to cause the click wrench emulator mechanism 38 to assume the release position shown in FIG. 5 to generate the audible click, tactile impulse and slight torque load reduction (step 524). If angular motion is then sensed with the application of low torque (as when the user has moved on to another fastener) the CPU 94 clears the angle accumulation and reinitializes the process (step 502).

Figure 13:
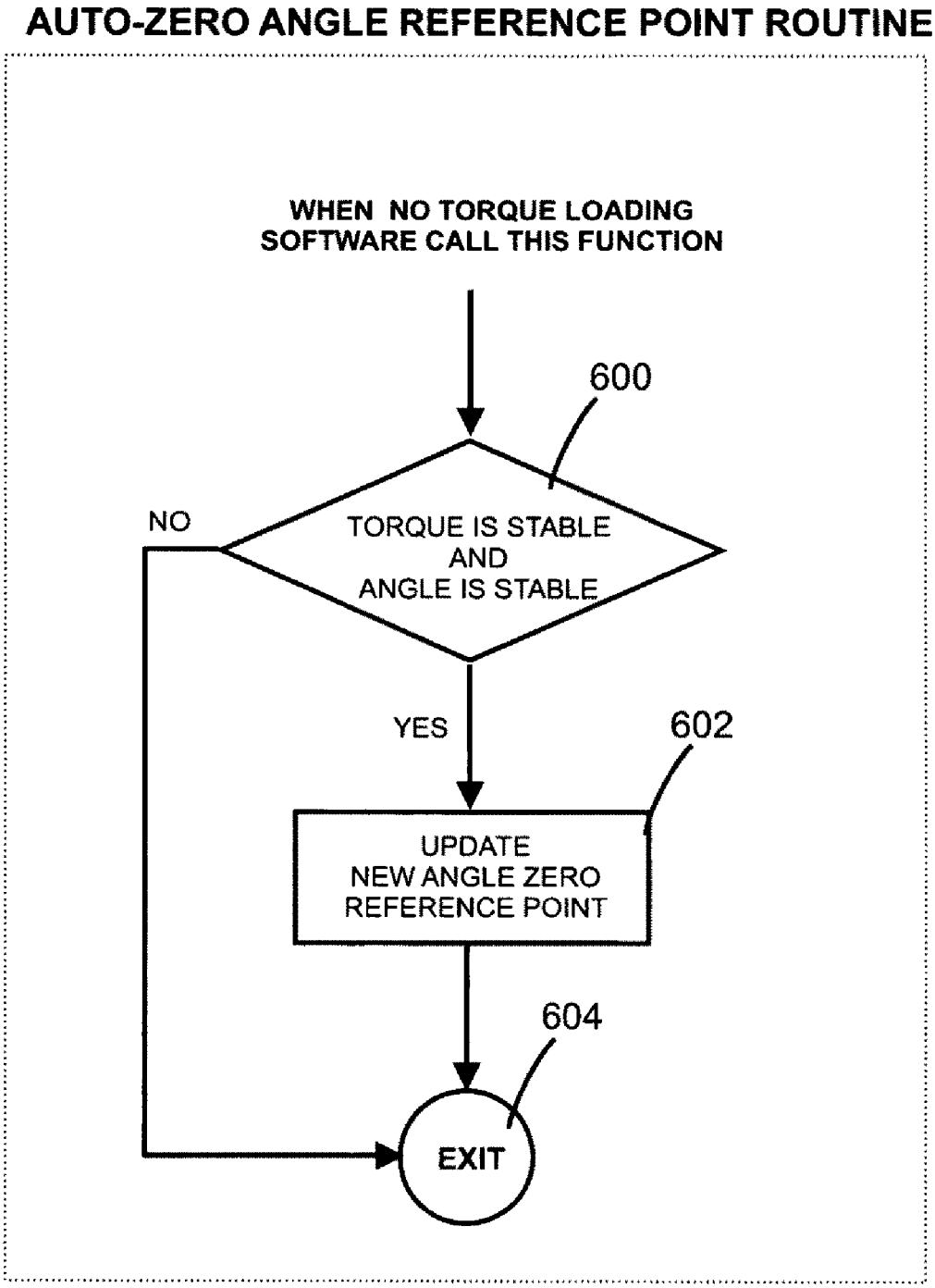
FIG. 13 is a flow chart of the auto-zero angle reference point routine.

FIG. 13 illustrates the flow process for the auto-zero angle reference point routine. From the angle measurement modes of FIG. 11 or 12 explained above, the CPU 94 monitors the torque and angle sensors simultaneously (step 600). Whenever both measurements are near zero and stable (step 600), the CPU 94 will update the angle zero reference point (step 602). With either input signal changing, such as during torque loading or angular rotation operations, the processor with exit the auto-zero angle routine (step 604) and revert to normal measurement functions. Therefore, compensation for angle zero drift is accomplished continuously (during any period of idleness) without the need for user input.

Thus, the present invention provides a measurement of the torque applied to the ratchet head driver 24 by a hand-operated wrench 20. The wrench 20 is fitted with strain gauges (e.g., 48) in a bending beam configuration that responds to this torque. The bending beam 26 is supported at both ends within the wrench housing 30 and may be fitted with additional gauges for hand-hold position error correction.

The present invention also provides the measurement of angular rotation of the ratchet head driver 24. This measurement is derived by means of a micro-machined three-axis accelerometer or gyro sensor 27. Angle preset parameters are adjustable and may be utilized to monitor threaded fastener rotation. Angle measurement zeroing is automatic, instant and requires no specific user interface.

In combination with each other, the torque and angle measurements allow enhanced capability for specific or more complex ratchet head driver 24 installation control. As analog signals, both torque and angle measurements are converted to digital values by a CPU 31, and are serially interfaced to a CPU 94 that interprets the measurement parameters and compares them to manually entered presets. Some of these preset conditions also include mathematical algorithms that respond to various fastener installation methods.

For example, certain fastener installations will require the application of a seating torque to a number of fasteners in a mechanical assembly. Subsequent to the seating, a certain loading of fastener is specified in terms of angular rotation. Alternatively, the assembly specification may require applications of torque and angle to the numerous fasteners in a certain pattern to result in a balanced loading. To assist the user in accomplishing these wrenching steps in proper order, the electronics display 50 may be programmed to call out the torque, angle and particular fastener to load sequentially.

In another example, with precision torque and angle measurements accomplished simultaneously, a technique known as torque-to-yield may be employed using the present invention. This method of threaded fastener installation compares torque and angle measurements simultaneously and plots them mathematically. Fundamentally, when the fastener remains in the elastic state, torque will increase as it is rotated. As the fastener approaches a state of metallurgical yield, the torque parameter will increase less in proportion to the angular rotation. A point of maximum load can be determined and the wrench 20 can be preset to signal the completion of installation by means of its simulated click function.

With the simultaneous measurement of torque and angle parameters, the wrench can also provide fastener installation error checking. For example, if a first torque has already been applied to a given fastener and then applied a second time, there will be no rotation measurement. The wrench 20 will signal to the user that torque has already been applied.

It is another capability of the present invention to provide accurate measurement of torque and angle parameters after the release signal (FIG. 5) has been generated. With this, it can capture over-torque and over-angle errors and report wrench misuse to the user. For example, inexperienced users will typically apply torque beyond the preset value because they fail to anticipate the release signal or are working too rapidly.

The wrench 20 can provide an audible, visual or digital message to assist the users in learning proper wrenching techniques.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An electromechanical wrench, comprising:

a housing that has a working end and a gripping end, with a driver positioned at the working end, and a handle positioned at the gripping end;

a click wrench emulator mechanism provided at the handle, the mechanism including:

a handle lever that partially extends outside the housing at the handle and which is pivotally coupled to the housing;

a hammer that resides inside the housing and is pivotally coupled to the housing, the hammer having a striking edge that is normally spaced-apart from the handle lever;

a sear pivotally coupled to the housing and having a portion thereof that normally engages the hammer;

a solenoid coupled to the sear; and wherein the solenoid is actuated to cause the sear to pivot, thereby causing the sear to be disengaged from the hammer, the hammer being biased to cause the striking edge to strike the handle lever.

2. The wrench of claim 1, wherein the hammer has a stepped edge and the sear has a notched edge that normally engages the stepped edge.

3. The wrench of claim 1, wherein the mechanism further includes a hammer spring that is coupled to the handle and the hammer, and which biases the hammer towards the handle lever.

4. The wrench of claim 1, wherein the upper portion of the housing at the handle is opened to allow the hammer to strike the handle lever.

5. The wrench of claim 1, further including a torque sensing beam positioned adjacent the working end, and a signal processing module provided on the torque sensing beam.

6. The wrench of claim 5, further including a display and controller module that is coupled to the signal processing module, the module including a display controller.

7. The wrench of claim 6, wherein the torque sensing beam, and the display and controller module are positioned between the driver and the click wrench emulator mechanism along the housing.

8. The wrench of claim 5, wherein the torque sensing beam is integral with the driver as a unitary working end piece, with the unitary working end piece being removable from the housing.

9. The wrench of claim 5, wherein the signal processing module includes an angle sensor that is either a gyro sensor or an accelerometer.

10. The wrench of claim 9, wherein the signal processing module includes a torque sensor.

11. The wrench of claim 1, further including a vibrator positioned adjacent the handle.

12. A method of counting the number of fasteners secured by an electromechanical wrench during a wrenching job, comprising:

a. setting initial values for 50% and 96% torque levels from the target torque level;

b. initializing the torque value and the bolt counter values;

c. applying torque to a fastener using the wrench, and accumulating angle measurements between the 50% and 96% torque levels at an angle accumulator;

d. if the torque input is greater than or equal to the 50% torque level, then accumulating the angle value, otherwise holding the present angle value until the torque input is greater than or equal to the 50% torque level;

e. upon reaching the 96% torque level, checking the accumulated angle value for a pre-programmed angle allowance, and if the accumulated angle value exceeds the allowance, then the fastener is considered properly installed and the bolt counter is incremented by one, otherwise if the accumulated angle value is less than the accumulated angle value plus the allowance, issuing a signal to indicate that the fastener has been previously installed, and then resetting the angle accumulator; and f. repeating steps (a)-(e) for additional fasteners until the total number of fasteners counted equals the desired number for the wrenching job.

13. A method of using an electromechanical wrench to secure a fastener using angular measurement without the need for manually establishing a zero reference point, and allowing for ratcheting, comprising:

a. setting a target angle value and initializing a peak torque register;

b. clearing the displayed angle to "zero" when torque is first applied to the wrench;

c. applying torque to a fastener using the wrench, accumulating angle and torque measurements, and continuously updating the displayed angle;

d. using both torque and angle signals to correct for angle sensor drift continuously without the need for user input;

e. if the torque value does not increase, then holding the present angle value, otherwise increasing angle measurement if the torque value increases beyond the previously-recorded peak torque value;

f. completing the operation when the angle measurement equals the target angle value.

* * * * *